United States Patent [19]

Wu et al.

[11] Patent Number: 4,948,008

[45] Date of Patent: Aug. 14, 1990

[54] CAN END HAVING A PULL TAB CONNECTED TO A PULL-UP MEMBER WHICH CAN BE USED AS A PLUG

[76] Inventors: Jaw-Shyong Wu, No. 15-3, Ming-Li St., W. Dist., Tai-Chung City; Yun-Terng Wang, No. 50-3, Chung-Shin Rd., Puu-Li Chen, Nantu Hsien; Hann-Chang Wu, No. 85, Pei-Chern St., Puu-Li Chen, Nantu Hsien; Jiin-Tsong Shieh, No. 5, Sec. 1, Shi-An Rd., Puu-Li Chen, Nantu Hsien, all of Taiwan

[21] Appl. No.: 398,894

[22] Filed: Aug. 28, 1989

[51] Int. Cl.[5] ..... B65D 41/32

[52] U.S. Cl. ..... 220/212; 220/270; 220/90.2

[58] Field of Search ..... 220/212, 270, 272, 273, 220/271, 90.2

[56] References Cited

U.S. PATENT DOCUMENTS

| | | | |
|---|---|---|---|
| 3,246,792 | 4/1966 | Brackmann et al. | 220/270 X |
| 4,690,294 | 9/1987 | Jones | 220/90.2 |
| 4,877,129 | 10/1989 | Wells | 220/273 X |

*Primary Examiner*—Donald F. Norton

*Attorney, Agent, or Firm*—Ladas & Parry

[57] ABSTRACT

A can has two closed can ends, one of which is provided with a pull tab having a pull-up member connected to the pull tab. The pull tab can be torn away from the associated can end to form an opening by pulling up the pull-up member which is connected to the pull tab. The pull-up member includes a bottom portion and a tapered insert portion extending upwardly from the bottom portion. After the pull tab is detached from the can, the pull tab can be broken off from the pull-up member and the tapered insert portion can be used to snugly seal the opening in the can end.

8 Claims, 7 Drawing Sheets

CAN END HAVING A PULL TAB CONNECTED TO A PULL-UP MEMBER WHICH CAN BE USED AS A PLUG

BACKGROUND OF THE INVENTION

This invention relates to a can having a pull tab connected with a pull-up member provided at a closed end thereof which can be used as a plug after the pull tab is detached from said closed end of the can.

A conventional "easy-open" can end has a metal pull tab with a metal ring pull secured thereto. Such a pull tab can be torn away from the can end to form an opening and give access to the interior of said can for the purpose of drinking the liquid contained therein. However, if a consumer does not drink all of the liquid contained in the can at one sitting, the opened can and the remaining contents thereof will inconvenience the consumer as he/she carries said opened can.

SUMMARY OF THE INVENTION

It is therefore a main object of this invention to provide a can having a pull tab with a pull-up member provided on the can end thereof which is to be torn away to form an opening on said can end, wherein said pull-up member can be used as a plug to reseal said opening after said pull-up member is detached from said can end.

Accordingly, in accordance with the present invention, a can is provided which includes: two closed ends, one of which has an opening of a predetermined shape; a pull tab detachably sealing the opening; and a pull-up member attached to the pull tab, the pull tab being capable of being detached from the can end by pulling up the pull-up member so as to give access to the chamber in the can. The pull-up member is of the same shape in cross section as said opening. The pull-up member comprises a flat bottom portion positioned adjacent the can end, and a tapered insert portion extending upward from said flat bottom portion. The flat bottom portion of the pull-up member is connected to the pull tab. The insert portion includes a means for retaining one of the consumer's fingers. Thereby, the opening in the can end can be resealed by plugging the insert portion of the pull-up member into the opening of the can end after the pull tab is detached therefrom. In addition, the pull tab is provided with a pressed arcuate groove so that said pull tab can be broken off from the pull-up member by being bent along the pressed arcuate groove thereof after being torn away from the can end.

BRIEF DESCRIPTION OF THE DRAWINGS

Other features and advantages of this invention will become apparent in the following detailed description of a preferred embodiment of this invention with reference to the accompanying drawings, in which.

DETAILED DESCRIPTION OF THE PREFERRED EMBODIMENT

Figure 1:
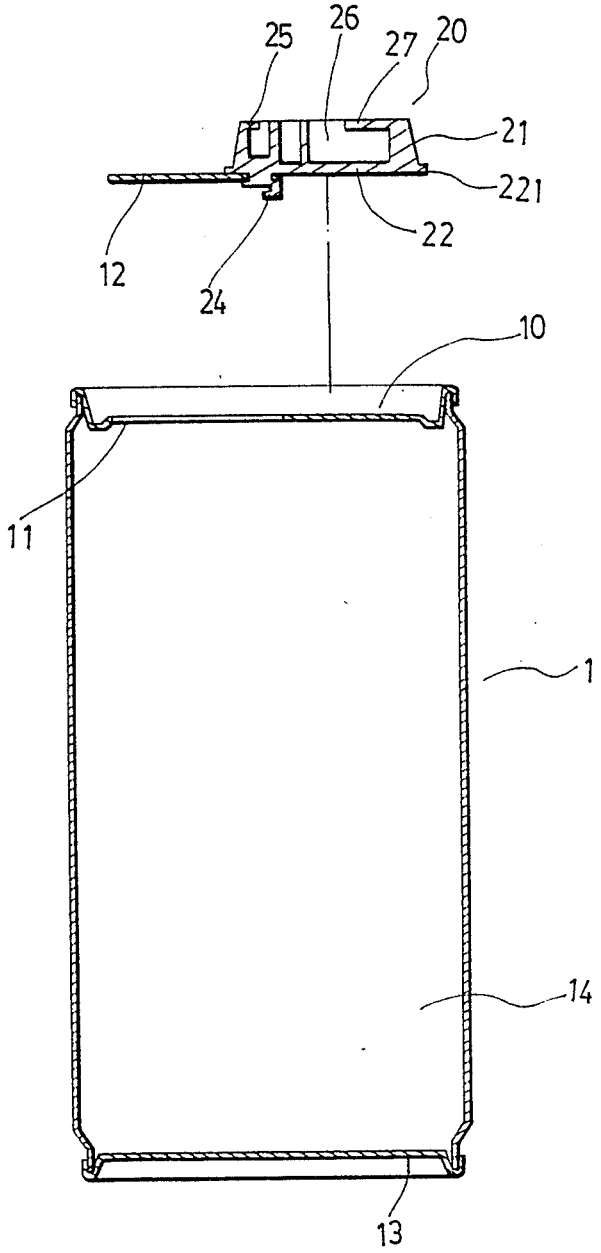
FIG. 1 is an exploded sectional view of a preferred embodiment of a can having a pull tab connected to a pull-up member provided at a closed end thereof according to this invention.
Figure 2:
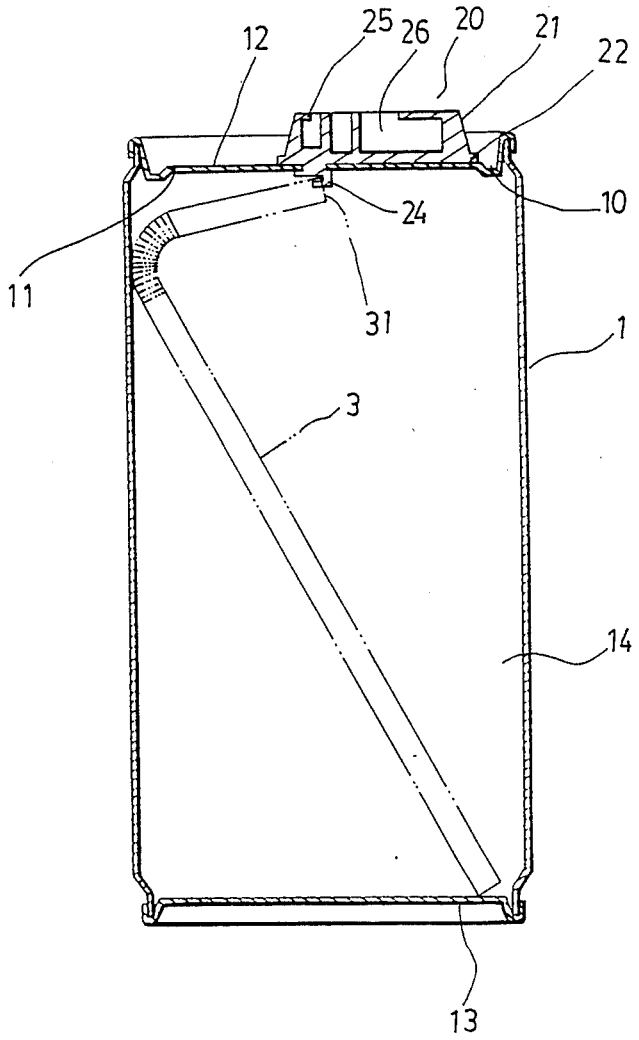
FIG. 2 is a sectional view of a preferred embodiment of a can having a pull tab connected with a pull-up member provided at a closed end thereof according to this invention.

Referring to FIGS. 1, 2, a preferred embodiment of a can 1 with an upper and a lower closed end 10, 13 defining a chamber 14 therein, according to this invention, is shown. The upper closed end 10 is formed with a pear-shaped opening 11 which is detachably sealed by a pear shaped pull tab 12 (see FIG. 5). The pull tab 12 has a pull-up member 20 connected thereto, which is to be detached from the upper can end 11 by the pulling up thereof so as to give access to the chamber 14 in the can 1.

Figure 4:
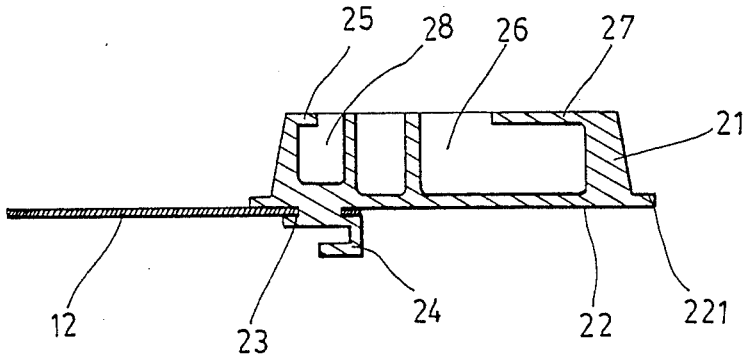
FIG. 4 is a sectional view of a pull tab having a pull-up member bonded thereto according to this invention.
Figure 5:
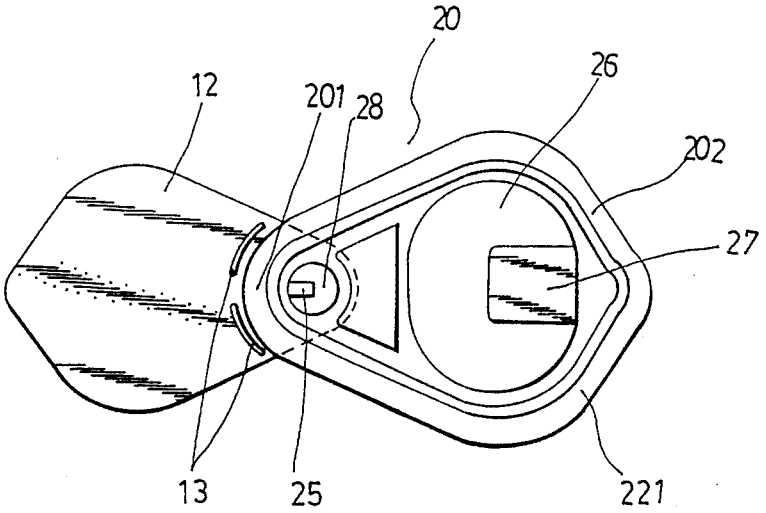
FIG. 5 is a top view of the pull tab and the pull-up member of FIG. 4.

Referring to FIGS. 4, 5, the pull-up member 20 is made of a plastic material, such as polyurethane. The pull-up member 20 comprises a flat bottom portion 22 at a position parallel and adjacent to the upper can end 10, and an insert portion 21 taperingly and upwardly extending from the bottom portion 22. The pull-up member 20 is generally pear-shaped in cross section which has a narrow side 201 and a broad side 202 opposed to the narrow side 201, as best illustrated in FIG. 5. A peripheral flange 221 extends outwardly along the bottom portion 22 of the pull-up member 20. The bottom portion 22 of the pull-up member 20 has a connecting portion 23 extending downward therefrom near the narrow side 201 of the pull-up member 20. The connecting portion 23 has an L-shaped hook member 24 which extends downward therefrom so as to hook on one end 31 of a drinking straw 3, as best illustrated in FIG. 2. Thereby, said end 31 of the drinking straw 3 can be pulled out of the opening 11 of the upper can end 10 when the pull tab 12 is torn away. A recessed portion 26 is formed in the insert portion 21 of the pull-up member 20 which opens at a flat face remote from and, parallel to, the bottom portion 22 of the pull-up member 20. A retaining plate 27 horizontally and inwardly extends from the edge of the recessed portion 26 adjacent the broad side 202 of the pull-up member 20 so that one of a consumer's fingers can hook the retaining plate 27 in order to pull up the pull-up member 20 and thereby, tear the pull tab 12 away from the upper can end 10. At the narrow side 201 of the pull-up member 20, a hole 28 is formed in the insert member 21 which opens to said flat face of said pull-up member 20 and a protrusion 25 horizontally and inwardly extends from the edge of the hole 28 which is opposite to the retaining plate 27.

Figure 3:
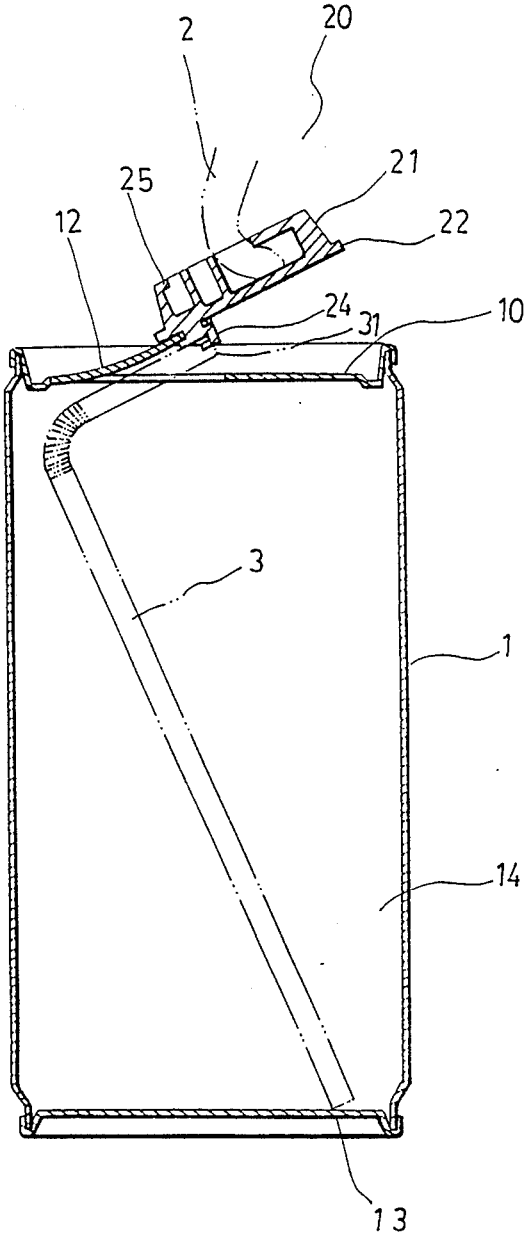
FIG. 3 is a sectional schematic view showing the closed can end of FIG. 2 which is to be opened by pulling up the pull tab.
Figure 6:
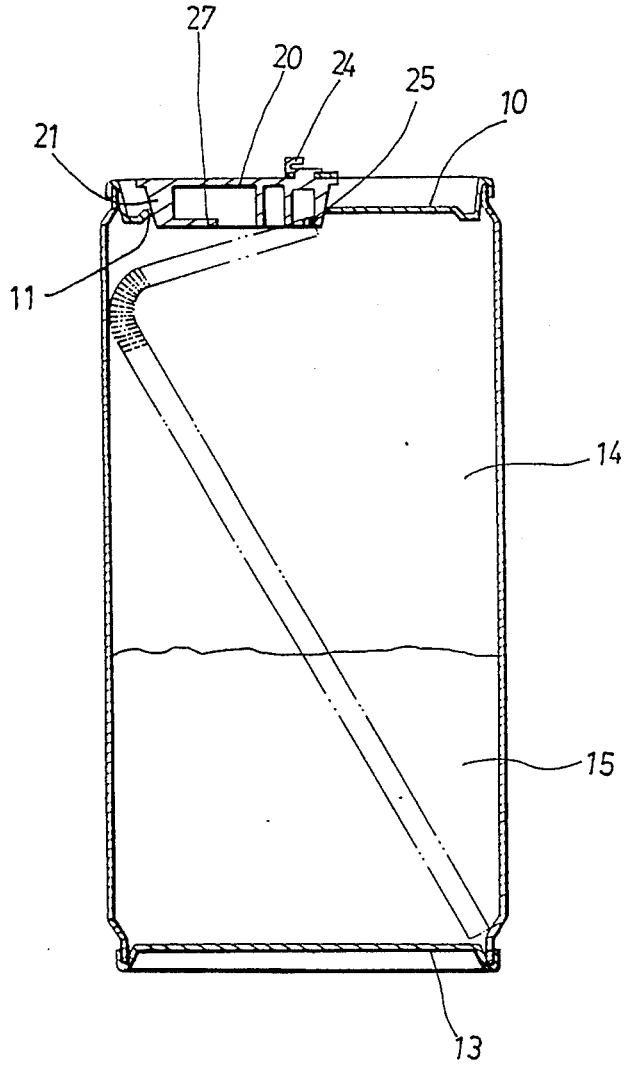
FIG. 6 is a sectional view of a preferred embodiment of a can which is resealed by the pull-up member according to this invention.
Figure 7:
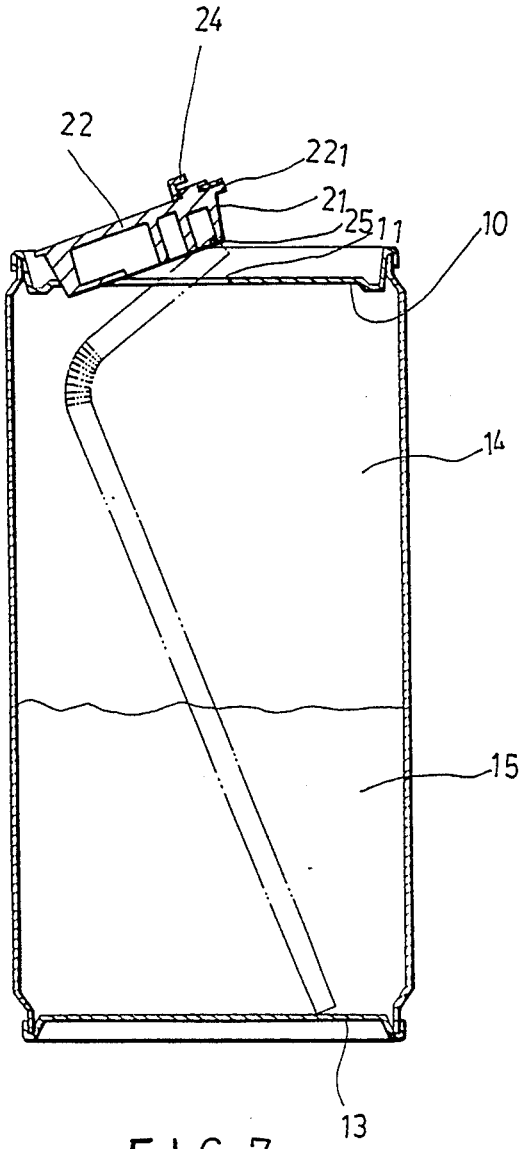
FIG. 7 is a sectional schematic view showing the pull-up member being pulled out from the can end of FIG. 6 according to this invention.

Referring to FIG. 3, to create the opening 11 and thus give access to the chamber 14 in the can 1, a consumer can insert one of his/her fingers 2 into the recessed portion 26 of the insert portion 21 of the pull-up member 20 and hook the retaining plate 27 and then, in turn, pull up the pull-up member 20 and the pull tab 12. In this position, the end 31 of the drinking straw 3 will be pulled out of the opening 11 of the can 1 by the L-shaped hook member 24 for drinking purposes. After being completely detached from the upper can end 10, the pull tab 12 is broken off from the pull-up member 20 by being bent along two pressed arcuate grooves formed near the narrow side 201 of the pull-up member 20. The tapered insert portion 21 thereof, facing downward, can be used to snugly seal up the opening 11 and reseal the opening 11 with the protrusion 25 thereof hooking in said end 31 of the drinking straw 3, as best illustrated in FIG. 6. In this way, the remaining liquid contents 15 of the can 1 will not be spilt when a consumer carries said can 1 from one place to another. By grasping the flange, a consumer can pull up the pull-up member 20 for gaining access to the chamber 14 in the can 1. Meanwhile, the end 31 of the drinking straw 3 is pulled out from the opening 11 of the can end 10 for drinking purposes, as best illustrated in FIG. 7.

With this invention thus explained, it is apparent that numerous modifications and variations can be made without departing from the scope and spirit of this invention. It is therefore intended that this invention be limited only as indicated in the appended claims.

We claim:

1. A can having two closed ends defining a chamber, one of said can ends having an opening of a predetermined shape; a pull tab detachably sealing said opening; and a pull-up member attached to said pull tab, said pull tab being capable of being detached from said can end by pulling up said pull-up member so as to give access to said chamber; the improvements comprising said pull-up member, which is of the same shape in cross section as said opening, said pull-up member comprising a bottom portion positioned adjacent said can end and a tapered insert portion extending upward from said bottom portion, said bottom portion being connected to said pull tab, said insert portion including a means for retaining one of a consumer's fingers; whereby said opening of said can end can be resealed by plugging said insert portion of said pull-up member into said opening after said pull tab is detached from said can end.

2. A can as claimed in claim 1, wherein said pull-up member is pear-shaped in cross section having a narrow side and a broad side opposed to said narrow side.

3. A can as claimed in claims 2, wherein said pull-up member is integrally formed from a plastic material.

4. A can as claimed in claim 3, wherein said bottom portion of said pull-up member is a substantially flat plate having a flange extending outwardly from a periphery thereof; and said tapered insert portion of said pull-up member has a truncated flat face remote from and parallel with said bottom portion thereof.

5. A can as claimed in claim 4, wherein said retaining means includes a recessed portion, adjacent said broad side of said pull-up member, which opens at said flat face of said insert portion with an edge which meets with said flat face, and a retaining plate inwardly extending from said edge of said recessed portion.

6. A can as claimed in claim 5, wherein said pull-up member has a connecting portion extending from said bottom portion thereof and into said chamber of said can near said narrow side of said pull-up member, said connecting portion being fixed to said pull tab.

7. A can as claimed in claim 6, wherein said connecting portion of said plug portion has an L-shaped hook member extending therefrom in said chamber of said can.

8. A can as claimed in claim 7, wherein said pull tab has a pressed arcuate groove formed thereon near said connecting portion of said pull-up member, so that said pull tab can be separated from said pull-up member by being bent along said pressed arcuate groove.

* * * * *